US007987759B2

(12) United States Patent
Stark et al.

(10) Patent No.: US 7,987,759 B2
(45) Date of Patent: Aug. 2, 2011

(54) PLASMA JET IGNITER USED FOR AN ELECTRO-THEREMAL-CHEMICAL (ETC) GUN, MACHINE GUN OR OTHER BARRELED WEAPON OR EQUIVALENT TYPE

(75) Inventors: Ola Stark, Hammaro (SE); Mats Lofgren, Visby (SE); Lars Peter Svanberg, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 1222 days.

(21) Appl. No.: 10/548,022

(22) Filed: Mar. 14, 2006

(65) Prior Publication Data

US 2011/0155011 A1 Jun. 30, 2011

(30) Foreign Application Priority Data

Mar. 15, 2005 (SE) ..... 0500581

(51) Int. Cl.
*F41A 19/55* (2006.01)

(52) U.S. Cl. ..... 89/1.11; 102/440

(58) Field of Classification Search ..... 42/84; 102/440; 89/1.11
See application file for complete search history.

(56) References Cited

U.S. PATENT DOCUMENTS 5,938,950 A * 8/1999 Gay et al. ..... 219/121.54
2002/0157559 A1* 10/2002 Brunet et al. ..... 102/472
* cited by examiner

*Primary Examiner* — Stephen M Johnson
(74) *Attorney, Agent, or Firm* — Jacobson Holman PLLC

(57) ABSTRACT

A method is provided for an electric activation of a plasma jet igniter for firing Electro-Thermal-Chemical (ETC) guns, machine guns and other equivalent ETC barreled weapons, without complete consumption of any of the components necessary for its activation upon activating the igniter. Each activation of the igniter by means of one or several voltage pulses, which from an electric pulse generator (10) are conducted between an anode (4) and a cathode (5), is preceded by heating of the anode (4) to such high temperature that at least parts of the dielectric material (2) arranged in proximity to the anode (4) have begun to vaporize. The method may be implemented using an adapted plasma let igniter which has an anode that can be heated to a high temperature so that the igniter can be used for firing whole series of rounds or a full magazine of successively fired rounds in rapid order.

5 Claims, 1 Drawing Sheet

Figure 1:
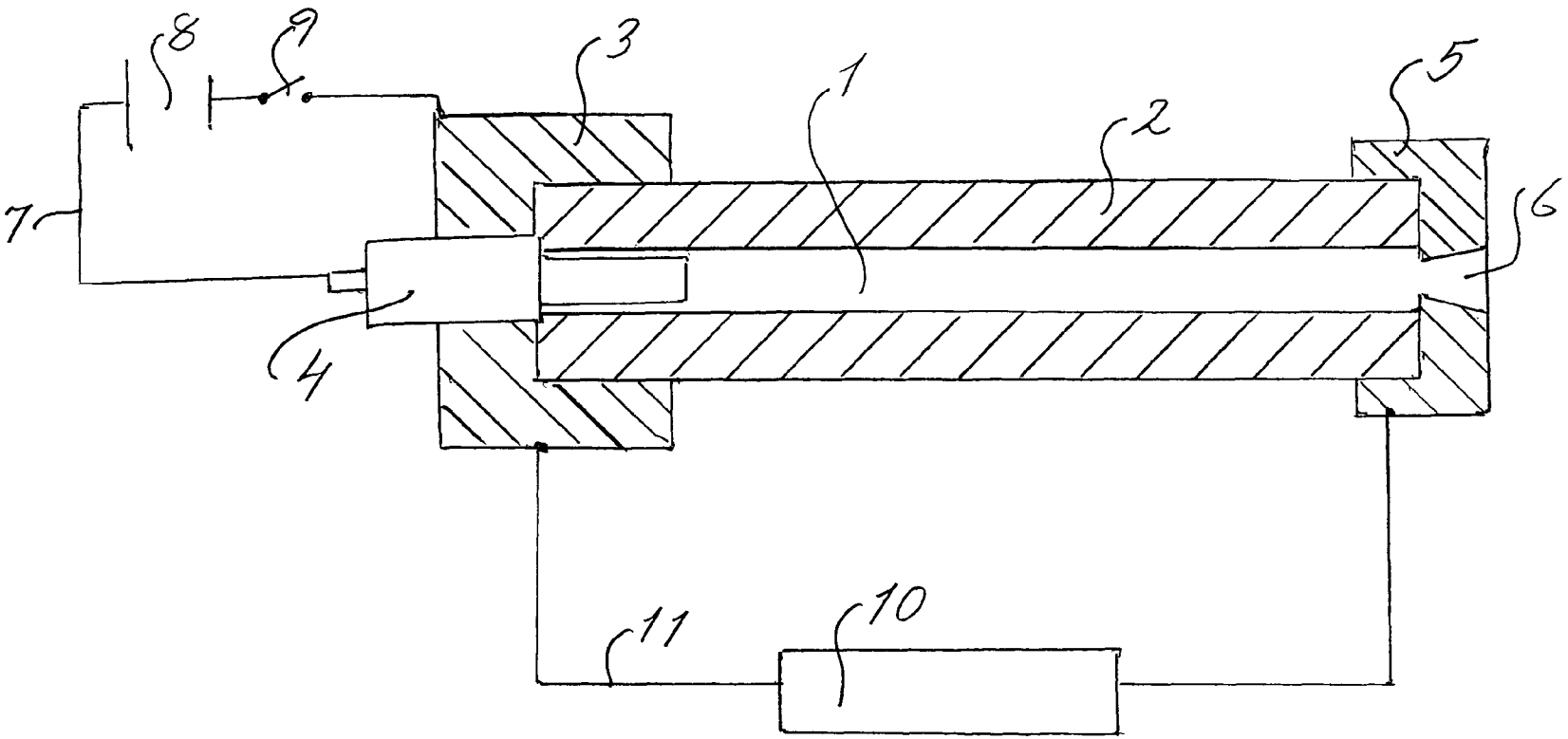

PLASMA JET IGNITER USED FOR AN ELECTRO-THEREMAL-CHEMICAL (ETC) GUN, MACHINE GUN OR OTHER BARRELED WEAPON OR EQUIVALENT TYPE

TECHNICAL AREA

The present invention refers to a method for an electric activation of a plasma jet igniter for firing Electro-Thermal-Chemical (ETC) guns, machine guns and other equivalent ETC barreled weapons, without complete consumption of any of the components necessary for its activation upon activating the igniter. It has become possible, with regard to the specific method of igniter activation, to utilize one and the same plasma jet igniter for serial firing, after reloading of the relevant firing gun, of several successive rounds equipped with pyrotechnic main propellants. The invention also includes the constructive design of an adapted plasma jet igniter, for use in aforementioned method, which, thus, has the distinguishing unique property of being able to be used for firing whole series of rounds or a full magazine of successively fired round in rapid order.

Characteristic of the electro-thermal-chemical propellant principle is that the electro-thermal plasma utilized for the initiation of the weapon's pyrotechnic main propellant can also, to a certain extent, be utilized for correction of the muzzle velocity ($V_0$) of the projectile fired out of the weapon. This is, however, a secondary result in relation to the present invention, whose special functionally distinguishing property, as stated earlier, is that it in accordance with the therewith embodied plasma jet igniter can be used for firing several rounds in rapid succession. The plasma jet igniter in accordance with the present invention is namely dependent neither on any glow wire, connected between the igniter's anode and cathode, nor of any special primer fuel, such as, e.g., fine grade steel wool, which otherwise is often used for the single use plasma jet igniter sort. Especially distinguishing for the plasma jet igniter in accordance with the function of the present invention is, thus, how it is started up and is brought to generate its plasma without complete consumption of any of its components used in the start-up.

PROBLEM PRESENTATION AND BACKGROUND TO INVENTION

One of the technical problems that has been the basis for the present invention has been how one might, from one barreled weapon, be able to fire several rounds in rapid succession from one and the same barrel, where all rounds shall impact against a selected target more or less simultaneously, that is, how one might accomplish a proverbial "Multi-Round Simultaneous Impact" (MRSI) effect. MRSI requires that each round's trajectory to the target and its muzzle velocity must be able to be varied with a high degree of exactitude. One known problem, thus, means that fact that the conventional propellants include propellant and/or explosives that can have some transient combustion properties, which brings about some variations between the individual charges. Said properties are also dependent on the temperature at which the round is fired. A further problem is that the relevant barreled weapon, regardless of its caliber and type can only hold a known, defined number of charges. The present invention deals primarily with barreled weapons with larger calibers, such as artillery pieces, tank canons, anti-armor weaponry, etc., which, however, does not exclude that the invention can also be used for weapons with smaller calibers, such as proverbial Gatling guns and machine guns, etc.

One has to have access to different propellant charges, that can be adapted and combined for a given target, the target's range from the weapon, relevant weather conditions, etc., in order to effectively be able to fire on different targets. This means that a given, defined amount of charges must be rammed in the weapon prior to each round, where the number of charge types included is defined by said range, given temperature, etc. The weapons' effect must also be adapted to whichever given round in a salvo as is applicable, in order that an as optimal muzzle velocity ($V_0$) as possible is achieved for every individual round.

A high muzzle velocity ($V_0$) is desirable when it can be utilized to increase the artillery range, improve penetration capability of tank canons, or reduce the flight time of projectile trajectory in order to thereby make it easier to combat targets that make evasive maneuvers, such as in anti-air artillery applications, etc. Thus, great efforts have been made and continue to be made in order to achieve an ever higher muzzle velocity ($V_0$).

It is also desirable that the muzzle velocity ($V_0$) is as variable as possible in order to achieve the best MRSI effect possible. For example, the MRSI effect can be achieved by firing each round in the salvo at the same muzzle velocity ($V_0$) but at different elevations so that the thereby differing projectile trajectories become of such different lengths that the impact is simultaneous in any case despite the time difference between firings, or the firings occur at different elevation angles and different muzzle velocities that are adapted to the range and the time difference between the firings. The successively increasing muzzle velocity ($V_0$) for each round in a salvo is achieved toady by increasing the number of propellant charges for each round and/or by using different charges with increasing energic content. The same effect can, thus, also be achieved, to a certain extent, by the proverbial ETC technology, according to which further propellant energy can be conferred to the projectile in the form of electro-thermal energy that is conferred to the round through the electro-thermal plasma that is primarily used to ignite the pyrotechnic main propellant. This principle is based on the electrical energy is conferred to the round through the electro-thermal plasma by having the electro-thermal plasma account for an increased gas pressure behind the projectile.

The Electro-Thermal-Chemical canon technology means, however, that conventional fuses for the ignition of the pyrotechnic propellant charge can not be used. The fuse for ETC canons are instead replaced by an electric igniter of the plasma generator type, which aside from initiation of the given round's pyrotechnic propellant charge, can, thus, also make possible that a certain amount of electric energy can be conferred, in the form of gas pressure behind the projectile increased by the plasma, to each round. This possibility to increase the gas pressure behind the projectile can also be utilized in order to compensate for the possible differences that can occur between successive firings in one salvo. Assuming that the electric energy conferred to the plasma is maintained during the entire propulsion of the projectile through the barrel, then either the projectile weight can increase, compared with conventional canons, despite the muzzle velocity obtained or the muzzle velocity can increase despite the projectile weight obtained. The cost of a plasma generator is, however, considerably higher than that of a conventional igniter, which is why it is desirable to find a method to fire rounds in a series with one and the same plasma generator. To date, however, no one has introduced a sufficiently good plasma generator for firing several rounds in a salvo onto the market to the best of our knowledge. The alternative has, to date, been to equip each round with its own plasma generator.

The requirement of a good electrical contact, under all conditions, between the electro-thermal plasma jet igniter and an electric pulse generator utilized for the activation of the igniter, as well as a high degree of active service orientation, means that it is advantageous if one can utilize one and the same igniter for all rounds in one and the same salvo and, further, to have the plasma jet igniter installed in the firing gun's breech or endpiece.

Electro-Thermal-Chemical (ETC) plasma jet igniter, and ETC propulsion, thus, deal with and electric igniter of the plasma generator sort, which to date has usually been arranged inside an ETC adapted ammunition round but that could have also been a separately arrangement connected to the breech ring of the weapon (see U.S. Pat. No. 4,895,062) and which plasma generator is intended to ignite the round's propellant charge comprising a propellant or an explosive substance for achieving a propulsion of the round's warhead through a barrel by both the chemically formed propellant gases from the combustion of the propellant charge, itself, and, further, by the electric energy conferred by the plasma. The latter can afford a variable energic content upon by electrification, makes up, in part, from at least a suitably conductive consumable material, initial ionized plasma that is used to ignite the propellant charge, itself, and, in part, a second ionized plasma that is formed after the ignition of the propellant charge.

The first ionized plasma is created in most cases inside the igniter during the consumption of the one or several of the consumable material, of suitable sort, there arranged, of which one is electrically conductive, and then can be made of fine steel wool, while the other consumable materials can preferably be of lighter material such as plastic but even different fluids can be used for this end. A powerful electric current is led, upon starting up the conventional plasma jet igniter, at high voltage through the conductive consumable material so that it is heated to such a high degree that it, and other suitable consumable material, is vaporized and ionized and form the initial plasma.

Generally it is also the case with plasma jet igniters that the plasma, developed therein due to the resultant high pressure inside the plasma jet igniter, is forced to spurt out as one or several jet streams, which jet streams, in turn, ignite the propellant charge, itself. The propellant gases formed thereby can also, as earlier indicated, confer further energy through a variable electrical energy supplement by means of an added voltage along the barrel whereby the second plasma forms.

PRIOR ART

As indicated earlier in the introduction, the distinguishing characteristic for the plasma jet igniter in accordance with the invention is how it starts up and is rendered able to generate its initial plasma. With regard to older plasma jet igniters, known by prior art, it is, thus, this detail that is of special interest in this context.

In the case of U.S. Pat. No. 4,895,062, the igniter espoused is, thus, activated the, there described, plasma generator by means of a glow wire which, in turn, ignites an undescribed primer fuel that, however with a given degree of certainty, can be assumed to have been made of fin steel wool.

With regard to the utilization of a voltage bearing glow wire, between anode and cathode, for activation of the plasma generator as well as the need for a primary fuel means that the igniter is clearly of the single use sort because the glow wire shall burn up in relation to the plasma being formed simultaneously with the primer fuel being consumed, if not earlier.

In the U.S. Pat. No. 5,266,902, there is further shown a canon intended to fire a number of Electro-thermal (ET) rounds in succession by means of an electric ignition. The invention described therein is, however, directed toward a flexible current conductor that is not hindered by the canon recoil and endpiece sliding motion, while, on the other hand, the utilized round and how the ignition system is embodied lack further description. On the other hand, the text indicates that every round comprises a plasma generator whereby extra electric energy can be converted in to thermal energy. The canon described in the text is equipped to perform a repetitive rapid firing by means of electric ignition, but each individual round comprises, as also stated here, an individual, separate plasma generator, which is consumed together with the round upon its firing and the asserted plasma generator's design is, thus, not described further.

Further U.S. Pat. No. 5,413,025 describes an electro-thermal, proverbial, Gatling Canon that can fire a large number of rounds in a short time by means of utilizing a number of barrels that rotate in rapid succession during the firing of them one after another. The supplemented electrical energy is said to be able to be adaptable to each round's firing. e.g., in order to get a certain number of projectiles to impact the target simultaneously, despite that they are fired in a succession after one another from alternating barrels, by affording the rounds fired later a required supplement of electric energy in order to achieve the desired velocity difference. The rounds, not further elucidated in the text, shall according to the document be comprised of ETC rounds, but the Gatling Canon illustrated and described are still of the sort where each round comprises its own igniter that is consumed at each firing, i.e., only one round can be fired for each plasma generator. Thus, [this does] not [obtain] a repetitive firing by means of one and the same igniter as has been desired.

In U.S. Pat. No. 4,711,154, there is further described an electro-thermal plasma generator of the single round sort in which one forms a plasma from a first dielectric, preferably consisting of small spheres of polyethylene that start up and are part of the plasma that is formed by the second dielectric that forms the inside of the chamber in which the plasma is formed. In the example shown in the figures of that text, no glow wire is included between anode and the cathode that are arranged at either end of the given capillary chamber but the text stipulates that one had also planned that such a glow wire should be able to be needed.

In the publicly accessible USA Patent Application 2002/0170455, there is further described an ETC igniter in which a light beam, between an internal anode arranged in a plasma forming chamber and a ring-shaped cathode arranged in the desired direction of plasma stream, is utilized for the formation of a plasma.

All of the plasma generators or plasma igniters discussed above have been of a sort that form a plasma streaming forwards along the lengthwise direction of the plasma generator.

All plasma jet igniters described thus far are of the sort that feature one or several stream apertures, arranged in or beside the forward cathode, for the plasma generated in the igniter.

There is, however, also a second general sort of plasma igniter, namely the proverbial piccolo igniter, which features a number of laterally arranged stream apertures instead of having one or several forward apertures in the natural direction of the plasma stream. This sort of plasma generator, thus, does provide cause for the same forceful, forward-directed plasma stream but does provide, instead, a good lateral ignition. These plasma generators are usually said to be of the piccolo sort.

FIGS. 1 and 2 are examples of ETC igniters of the piccolo sort in the publicly accessible USA Patent Application 2002/0157559 in which it describes an ETC igniter comprising an outer tube-formed metallic shell equipped with an outer number of laterally arranged stream apertures, an inner tube-formed insulation or dielectric from which the plasma is formed, and an inner tube formed, thinly-walled fuse that connects the anode and cathode. This igniter, aside from being of the piccolo sort, is also of the single use sort with regard to it being dependent of the above named thin-walled fuse. There is, in the aforementioned Patent Application, also an example of a plasma generator based mainly on the same principles, that is, with a jet stream aperture in the center of the cathode instead of the piccolo's lateral apertures.

A number of electrically initiated plasma jet igniters are, thus, known, which are utilized to initiate a propellant charge ETC canons and equivalents thereto and which are ignited by an electric current but none of these older designs can be utilized for several rounds in succession by means of same plasma jet igniter in accordance with the invention described below.

THE PURPOSE AND UNIQUE CHARACTERISTICS OF THE INVENTION

The present invention refers, thus, to a method for an electric activation of a plasma jet igniter or generator for firing Electro-Thermal-Chemical (ETC) guns, machine guns and other equivalent ETC barreled weapons, without complete consumption of any of the components necessary for its activation upon activating the igniter. It has become possible, with regard to the specific method of igniter activation, to utilize one and the same plasma jet igniter for serial firing, after reloading of the relevant firing gun, of several successive rounds equipped with pyrotechnic main propellants. The invention also includes the constructive design of an adapted plasma jet igniter, for use in aforementioned method, which, thus, has the distinguishing unique property of being able to be used for firing whole series of rounds or a full magazine of successively fired round in rapid order.

The especially distinguishing characteristic for the plasma jet igniter in accordance with the present invention is, thus, that the desired plasma is initiated by one or several electrical pulses that are conducted between an anode, included in the igniter, and a cathode, at a distance from same anode and included in the igniter, and that said pulses are not conferred to the anode until same is heated to a high temperature that a dielectric material arranged in proximity to the anode has begun to vaporize. In a proposed design of the igniter in accordance with the present invention, said dielectric material, made up of a plastic material with low molar weight, surrounds an otherwise empty chamber where the chamber's walls extend between the anode and cathode. Fluoroplastics, polypropylene and polyethylene can be named as examples of plastic materials suitable for that purpose. The space between the anode and the cathode, in single use ETC igniter of the single use sort described earlier in the text and that, thus, as a rule contain some primer fuel that is consumed upon the igniter's start-up, are usually called capillary chambers, which is why that designation can also be used in this context. The only material that is actively consumed upon the initiation of the igniter, in accordance with the present invention, is the part of the capillary chamber's wall material that shall be included in the plasma formed and that amount of material that is consumed upon each initiation is very limited. The plasma jet igniter, in accordance with the present invention can, thus, be used for a large number of initiations, following one another in succession, which each entail the formation of a plasma streaming out from the igniter's cathode end initiating the propellant charge. Each such plasma activation could, further, entail that one or several electrical pulses from a pulse generator, generating the electric pulses, are transmitted between the hot anode and the opposed cathode.

The heating of the anode, included in the general design of the plasma jet igniter, distinguishing the present invention, to a sufficient high starting temperature, in order to make possible the formation the desired plasma, can suitably be accomplished by means of electric heating of same. The anode is suitably connected, for this purpose, to an individual heating circuit with a, e.g., battery at the same time as the anode and the cathode are connected to the electrical pulse generator from which one or several electrical voltage signals are released in succession as soon as the anode has reached the required temperature of the voltage fed to the anode.

Because the plasma jet igniter can be utilized for a repetitive firing of several rounds against different targets, or one or several shorter salvoes against one or several targets, alternatively automatic fire in very rapid succession or continuous fire, round after round, until the magazine is empty, it has become possible to, in part, save on costs and, in part, to simplify the reloading process for the given weapon and, in part, reduce the given ammunition's sensitivity to external damage. All these advantages have, thus, been able to be achieves by the different rounds not needing to be equipped with individual fuses or other individual ignition function.

The present invention also entails that the plasma jet igniter be utilized for a repetitive firing of several rounds in succession in such a manner that a Multiple Rounds Simultaneous Impact (MRSI) effect, wherein all rounds shall impact in same selected target essentially simultaneously, is to be achieved.

A further purpose of the present invention is to achieve a new and improved plasma jet igniter, which allows that one and the same plasma jet igniter can be utilized for a repetitive firing of several separate rounds where each round fired receives precisely defined round characteristics and especially that each individual round's muzzle velocity ($V_0$) can either be varied very precisely for each round or where each round in a given series receives essentially the same muzzle velocity ($V_0$) regardless of climatic conditions.

Aforementioned purpose, as well as other purpose not enumerated here, are achieved in a satisfactory manner by means that are indicated in the independent patent claims. Further embodiments of the present invention are indicated in the patent claims below.

ADVANTAGES AND EFFECTS OF THE PRESENT INVENTION UPON APPLICATION TO ETC WEAPONRY

One can, compared with the conventional weapon systems, either increase the projectile weight with maintained muzzle velocity ($V_0$) or increase the muzzle velocity ($V_0$) despite maintained projectile weight upon application of the present invention to desired weaponry applications and full utilization of the ETC effect described above.

According to the present invention, ignition is facilitated compared with conventional firing mechanisms, because the igniter, according to the present invention, wholly lacks moving parts. The igniter, according to the present invention, can also be utilized for a continuously variable increase in velocity in accordance with the ETC technique.

With regard to the pulse generator (or pulse aggregate), necessary for the function of the plasma jet igniter, in accordance with the present invention, it can be stated that it shall be of the sort that supplies electrical power, in the form of pulses, from 10 joules up to 1 megajoule with a voltage from between 1,000 Volts up to 20,000 Volts.

The pulse or pulses shall have a waveform with amplitude and wavelength that are suitable for achieving an ignition of the plasma and thereafter to enable the ignited plasma with sufficient and precisely defined electric energy to obtain an as optimal energic release as possible behind the projectile in order to guarantee that said projectile's muzzle velocity ($V_0$) reaches a maximum simultaneously as the pressure from the propellant never exceed the maximum allowable barrel pressure.

It can be generally stated that longer pulses confer more energy to the projectile but simultaneously more heat, which is why too high a temperature can damage the barrel. This risk can be limited by a number of precisely controlled and measured pulses in succession after one another. The direct form of the pulses is regarded as being less significant.

As indicated earlier, a suitable material with low molecular [molar] weight such as a fluoroplastic, polypropylene or polyethylene is, thus, to be utilized as dielectric consumable material in the capillary chamber between anode and cathode.

Further advantages and effects shall be made evident from study and observation of the subsequent, detailed description of the present invention, inclusive of a number of said invention's advantageous embodiments, patent claims and the enclosed drawn figures.

LIST OF DRAWINGS

In the following the present invention shall be described in greater detail with reference to the enclosed figures.

FIG. 1 is a schematic sketch of the proposed embodiment of the plasma jet igniter in accordance with the present invention with the component parts thereof shown in a lengthwise cross section together with the pulse generator, necessary for its utilization, and required electric circuits.

The plasma jet igniter, shown in the FIGURE in lengthwise cross section, comprises an internally extended, empty capillary chamber 1 formed by a tube 2 made of the dielectric material such as polyethylene. On one of the tube's ends a rear plate or end piece 3 made of an electrically conductive material is arranged and preferably of metal, in which a glow plug 4 of the diesel motor sort, functioning as an anode, is screwed in while the tube's 2 other end is covered by a similarly electrically conductive material and preferably made of metal, end piece 5, functioning as a cathode. As indicated in FIG. 1, the cathode 5 is embodied with a central nozzle 6, through which the plasma stream is intended to be able to stream out in the capillary chamber 1 in the direction from the anode towards the cathode and onward in that direction when the igniter is activated and one or several voltage pulses are conducted from the electric pulse generator 10 coupled to the tube end pieces by electric cable system 11.

The FIGURE also shows an electric heating circuit 7 for the glow plug (the anode 4) and in said heating circuit a current source 8 and circuit breaker 9 included. The plasma that receives a general direction of motion from anode to cathode shall then stream through the cathode's central nozzle 6. This shall, in accordance with the method of the present invention, thus, achieve the plasma being formed from parts of the capillary chamber's inner wall, i.e., the plastic tube's 2 interior but the amount of material consumed upon each activation is very limited, which is why each igniter can be activated several times in succession without any degradation whatever for the next activation. One and the same igniter can, thus be utilized for firing of a large number of rounds in succession, either in rapid succession after one another or with larger or smaller pauses between the different rounds.

The invention claimed is:

1. A method, when firing in succession several rounds of pyrotechnic propellants in electro-thermal canons, machine guns or other barrelled electro-thermal weapons, for electrically initiating the pyrotechnic propellants in each of the successively fired rounds with one plasma jet igniter by:

electrically heating an anode included in the plasma jet igniter to such a high temperature that a portion in proximity to the anode of the dielectric material, which dielectric material electrically insulates the anode and a cathode included in the plasma jet igniter, from one another, is vaporised; that said vaporised portion of all the dielectric material available is sufficient, when activating the plasma jet igniter, to form in the direction from the anode toward the cathode, an electro-thermal plasma stream; connecting the anode and the cathode to respective poles on a pulse generator for the initiation and maintaining of the electro-thermal plasma stream in said direction from the anode toward and past the cathode; conducting at least one voltage pulse from the electric pulse generator between the anode and the cathode and thus activating the plasma jet igniter forming the electro-thermal stream past the cathode; consummating only that portion of all the dielectric material available necessary for the forming of the electro-thermal plasma stream by the activating of the plasma jet igniter and thus electrically initiating the pyrotechnic propellants in each of the successively fired rounds by using only one plasma jet igniter.

2. The method in as claimed in claim 1, wherein the anode is heated to an incandescent temperature before the pulse generator is activated and each of said voltage pulses are conducted between the anode and the cathode.

3. The method claimed in claim 1 wherein the heating of the anode is done in an electric circuit independent of the pulse generator.

4. A plasma jet igniter for successively firing rounds from electro-thermal cannons, machine guns and other electro-thermal barrelled weapons comprising a capillary chamber lined with a dielectric material and having an anode and a cathode at each opposing end of the dielectric material, which anode and cathode each are connected to respective poles of an electric pulse generator for initiation and maintaining of a plasma stream in the direction from the anode toward and past the cathode, wherein the anode is connected to or embodied with electrical heating parts for heating the anode to such a high temperature that a portion of all available dielectric material is vaporised and which electrical heating parts are connected to an electrical heating circuit independent of the pulse generator.

5. The plasma jet igniter as claimed in claim 4, wherein said anode comprises an electrically activated glow plug.

* * * * *